US008590356B2

(12) United States Patent
Kainer et al.

(10) Patent No.: US 8,590,356 B2
(45) Date of Patent: Nov. 26, 2013

(54) METHOD FOR THE PRODUCTION OF PROFILES OF A LIGHT METAL MATERIAL BY MEANS OF EXTRUSION

(75) Inventors: Karl Ulrich Kainer, Hohnstorf (DE); Jan Bohlen, Luneburg (DE); Piet-Jan Vet, Oisterwijk (NL); Pieter Hoogendam, Oisterwijk (NL); Luud Meijer, Drunen (NL); Wim Sillekens, Herten (NL); Jan Schade Van Westrum, Zevenaar (NL)

(73) Assignee: Helmholtz-Zentrum Geesthacht Zentrum für Material- und Küstenforschung GmbH, Geesthacht (DE)

( * ) Notice: Subject to any disclaimer, the term of this patent is extended or adjusted under 35 U.S.C. 154(b) by 1231 days.

(21) Appl. No.: 10/592,331

(22) PCT Filed: Mar. 3, 2005

(86) PCT No.: PCT/EP2005/002268

§ 371 (c)(1), (2), (4) Date: Oct. 9, 2007

(87) PCT Pub. No.: WO2005/087962

PCT Pub. Date: Sep. 22, 2005

(65) Prior Publication Data

US 2009/0044589 A1 Feb. 19, 2009

(30) Foreign Application Priority Data

Mar. 11, 2004 (EP) ..... 04005770

(51) Int. Cl.
*B21C 23/22* (2006.01)

(52) U.S. Cl.
USPC ..... 72/258; 72/271; 72/711

(58) Field of Classification Search
USPC ..... 72/253.1, 258, 271, 711, 363, 700, 264, 72/268; 148/420, 666, 667, 690, 700; 164/459, 476
See application file for complete search history.

(56) References Cited

U.S. PATENT DOCUMENTS 2,639,809 A * 5/1953 Perry et al. ..... 72/270
3,113,052 A 12/1963 Schneck (Continued)

FOREIGN PATENT DOCUMENTS

DE 19915276 * 5/2000 ..... C22C 23/06
EP 1069195 A2 1/2001

(Continued)

OTHER PUBLICATIONS

Journal of Light Metals, "The effect of zirconium grain refinement", Song et al., Jan. 2002.*

(Continued)

*Primary Examiner* — Edward Tolan
(74) *Attorney, Agent, or Firm* — Marshall, Gerstein & Borun LLP

(57) ABSTRACT

A method, for the production of profiles (16) of a light metal material, in particular a magnesium material, by means of extrusion with a hydrostatic extrusion device (10), is disclosed. A volume of material (15) is pressed through a die (14), having the form of the desired profile (16) in order to form the profile (16). A grain refiner is added to the light metal material to form the material volume (15) used in the extrusion process.

5 Claims, 3 Drawing Sheets

(56) References Cited

U.S. PATENT DOCUMENTS

Figure 1:
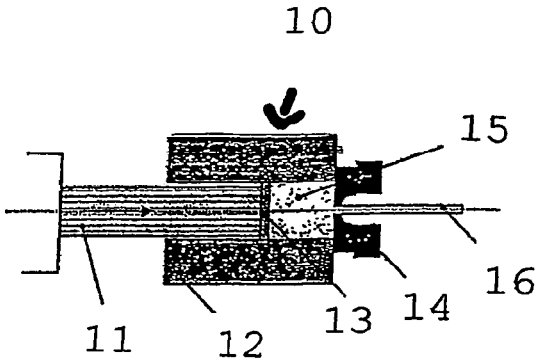

| | | | | | |
|---|---|---|---|---|---|
| 3,231,372 | A | * | 1/1966 | Foerster | 420/405 |
| 3,290,742 | A | * | 12/1966 | Petrovich | 164/459 |
| 3,884,062 | A | * | 5/1975 | Green | 72/60 |
| 3,926,690 | A | | 12/1975 | Morris et al. | |
| 3,967,485 | A | * | 7/1976 | Oguchi et al. | 72/60 |
| 4,462,234 | A | * | 7/1984 | Fiorentino et al. | 72/41 |
| 4,711,762 | A | | 12/1987 | Vernam et al. | |
| 4,997,622 | A | * | 3/1991 | Regazzoni et al. | 420/407 |
| 5,073,207 | A | | 12/1991 | Faure et al. | |
| 5,147,603 | A | | 9/1992 | Nussbaum et al. | |
| 5,503,690 | A | | 4/1996 | Wade et al. | |
| 6,412,164 | B1 | | 7/2002 | DeYoung et al. | |
| 6,627,012 | B1 | | 9/2003 | Tack et al. | |
| 6,695,935 | B1 | * | 2/2004 | Haszler et al. | 148/440 |
| 6,719,857 | B2 | * | 4/2004 | Ohori et al. | 148/424 |
| 7,018,954 | B2 | * | 3/2006 | Thieme et al. | 505/430 |
| 7,383,713 | B2 | * | 6/2008 | Wouters | 72/258 |

FOREIGN PATENT DOCUMENTS

| | | | | | |
|---|---|---|---|---|---|
| GB | 652223 | | | 4/1951 | |
| GB | 907404 | | | 10/1962 | |
| GB | 1069195 | | | 5/1967 | |
| GB | 1187305 | | | 4/1970 | |
| GB | 1 454 915 | A | | 11/1976 | |
| JP | 49 120863 | U | | 11/1974 | |
| JP | 60-221545 | | * | 11/1985 | B22C 21/06 |
| JP | 61-108416 | | * | 5/1986 | B21C 23/00 |
| JP | 61-183434 | | * | 8/1986 | C22C 21/06 |
| JP | 61-190051 | | * | 8/1986 | B21C 23/00 |
| JP | 1-261806 | | * | 10/1989 | H01F 7/02 |
| JP | 03097824 | A | | 4/1991 | |
| JP | 04231435 | A | | 8/1992 | |
| JP | 05 120055 | A | | 5/1993 | |
| JP | 2002-161326 | | * | 6/2002 | C22C 21/20 |
| JP | 2003-155547 | | * | 5/2003 | C22F 1/06 |

OTHER PUBLICATIONS

Jiangxi Xinji Metals, "The Application of Rare Earth Metals Widening", Lundin et al., Mar. 2005.*

International Search Report, PCT/EP2005/002268, Jul. 2005.

Japanese Office Action dated Dec. 21, 2010.

* cited by examiner

METHOD FOR THE PRODUCTION OF PROFILES OF A LIGHT METAL MATERIAL BY MEANS OF EXTRUSION

The invention concerns a method for the production of profiles of a light metal material, in particular a magnesium material, by means of extrusion, with a material volume being pressed through a die, which determines the form of the desired profile, to form the profile.

The production of profiles of light metal or light metal alloy materials by means of an extrusion method is an established technology that has been generally introduced and is applied in industry. It is, for instance, known that conventionally available light metal or light metal wrought alloys in the form of cast ingots can be pressed into profile forms using conventional extrusion. Here the light metal or light metal alloy ingot, designated succinctly and summarily in what follows by material volume, is inserted at temperatures in the range of 300 to 450° C. in a recipient of an extrusion device, with pressure being exerted via the punch of the latter on the material volume and it being pressed through a die into the desired profile form. The pressure on the material volume is here applied uniaxially via the punch.

An essential disadvantage of this established method is the limited press speed that can be attained with it, which has its basis not just in the method itself, but also in the light metal or light metal alloy materials which constitute the material volume. In the established extrusion devices or extrusion methods the material volume is pressed via the punch through the forming die. This gives rise to an area of friction between the material volume and the surrounding recipient, which on the one hand leads to an increase in pressure, but on the other, however, leads to heating up of the surface. Due to the pressure applied to one side of the metal volume in the recipient, the result is that the flow behaviour of the light metal or light metal alloy material is determined by the die. This results in the profile surface heating up, with heating up being dependent on the speed at which the light metal or light metal alloy material is pressed through the die. This then results in the fact that the press speed using the established method is limited to the extent that local superficial fusion occurs on the profile surface as it leaves the die. In such a case, we talk of so-called solidification crack susceptibility.

It is the task of the present invention to create a method by means of which the production of extruded light metal and light metal alloy materials for the production of profiles can be considerably simplified vis-à-vis previous methods of this type, and by means of which much higher production speeds are to be attained, with simultaneous improvement of the characteristics of the profiles produced, but allowing, by means of the method, the application of extrusion devices or extrusion methods that are in principle known to the state of the art. That is, the expenditure on instrumentation needed for performing the method and the performance of the method itself must, as far as possible, allow of implementation using techniques which are themselves established.

The task is solved in accordance with the invention by adding a grain refiner to the metal for the formation of the material volume that can be used for the extrusion process.

In accordance with the invention, the production of the material volume consisting of a fine grain cast material results from a variation in the composition of the material, by adding the above mentioned grain refiner to a conventional light metal or light metal alloy material of proven characteristics. The fine grain texture of the light metal or light metal alloy aimed at and achieved by the invention, where the light metal or light metal alloy is preferably a magnesium or magnesium alloy material, obtains such a fine grain texture that, as a result, considerable improvement of the mechanical characteristics, in particular of the ductility, measured as ductile yield in tensile testing, is obtained. By improving the plasticity of the light metal or light metal alloy material a significant improvement in the extrusion process is also obtained, so that the much finer grained texture of the material volume in the recipient of the extrusion device can be pressed at considerably lower temperatures. This results, moreover, in the light metal or light metal alloy material profile itself being in its turn of much finer grain, and this results in an improvement to the material characteristics of the profile and to a much higher press speed, since, in accordance with the invention, the solidification crack susceptibility of the profile surface is avoided.

The fine grain texture of the microstructure of the profiles that can be produced in accordance with the invention also results in stabilising, well distributed segregations in the material, which can lead to an increase in the mechanical parameters. Overall, the method in accordance with the invention can be performed at considerably lower temperatures than previous methods.

Suitable grain refiners are advantageously the metals zirconium, strontium and calcium, particularly if magnesium material or magnesium alloy materials constitute the light alloy material.

In another advantageous embodiment of the invention, the metals of the rare earths are also suitable as grain refiners, in particular also if magnesium or magnesium alloy materials constitute the light metal materials.

The method is advantageously performed in such a way that the temperature of the material volume in the recipient of an extrusion device is in the range from 150 to 350° C. when the extrusion process is performed, i.e. significantly below the temperature ranges which are needed for conventional extrusion methods, which are in the range of 300 to 450° C. The temperature for the extrusion process depends both on the composition of the light metal or light metal alloy material and essentially on the pressure applied to the metal volume in the recipient.

It is exceptionally advantageous that the speed of the extrusion amounts to up to 250 m $min^{-1}$, which corresponds to almost double the speeds attainable by means of previous methods.

Developing the method in accordance with the invention in such a way that the extrusion is effected by means of a hydrostatic press method has the exceptional advantage that the plasticity of the light metal or light metal alloy material, in particular a magnesium material, can be essentially increased by means of the hydrostatic extrusion, and the temperatures during the press process can be further reduced, since, as a result, the friction between the material volume and the surrounding recipient is to all intents and purposes not present and the applied pressure does not have to overcome any frictional forces working in opposition. In the case of the hydrostatic press method approximately the total forming pressure to be applied can thereby be used to build up the pressure which is to be applied for the pressure which is needed to press the metal volume through the die.

By this means, on the one hand, the temperature of the metal volume in the recipient can once again be reduced, and on the other hand, the press speed attainable by means of the method in accordance with the invention can once again be increased.

The invention will now be described in detail by reference to the following schematic drawings based on embodiment examples. In these FIG. 1 shows, by way of example, the schematic structure of an extrusion device with which a direct extrusion method may be performed, FIG. 2 shows, by way of example, the schematic structure of an extrusion device with which an indirect extrusion method can be performed, FIG. 3 shows, by way of example, the schematic structure of an extrusion device with which a hydrostatic extrusion method can be performed, as is used preferably in the method according to the invention.

Figure 4:
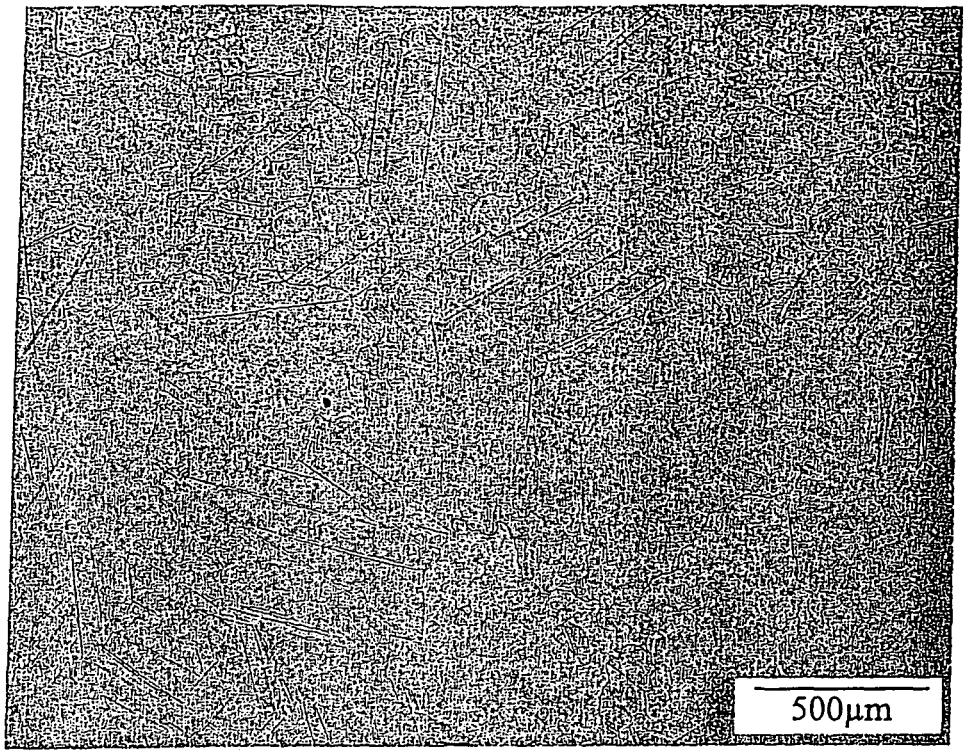
Figure 5:
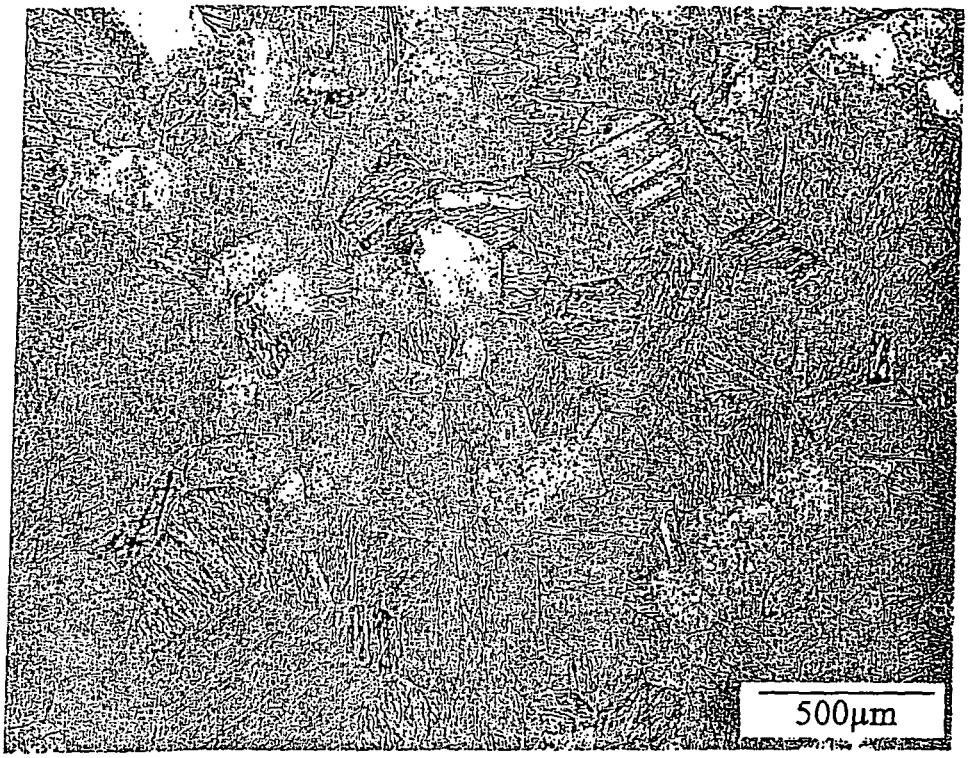

FIG. 4 shows an image by means of optical light microscopy of a texture of a conventional extruded metal volume (metal ingot) of AZ 31, and FIG. 5 shows an illustration like FIG. 4, but with the metal material Me 10 having been modified or refined with zirconium.

Figure 2:
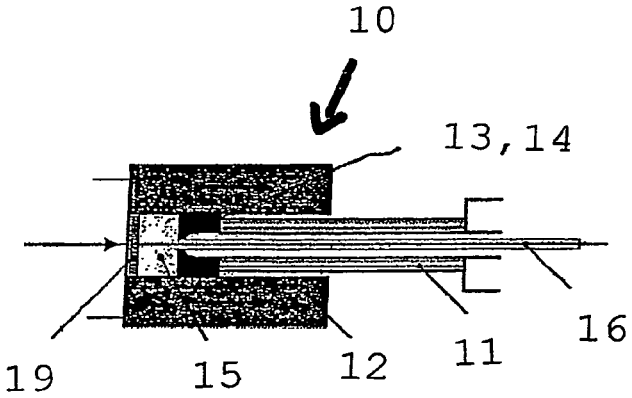
Figure 3:
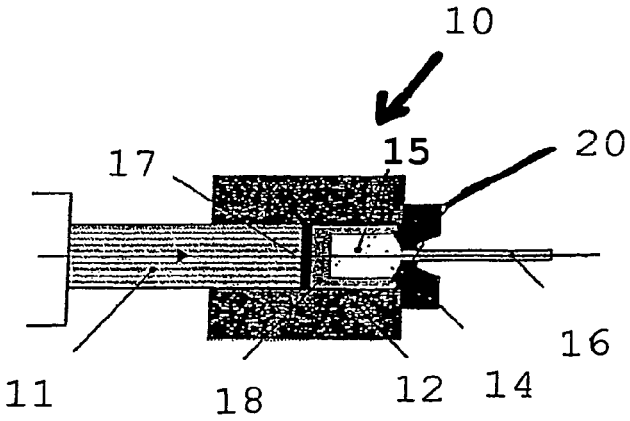

Before going into more detail on the actual method for the production of profiles of a light metal material, in particular a magnesium material, reference is first made to FIGS. 1 to 3, where, illustrated in schematic form, are the three extrusion devices that are as a rule known in the art, or extrusion devices 10, with which extrusion methods for the production of profiles in accordance with the invention can be performed. As these extrusion devices 10 or the methods that may be performed by means of such devices 10 are as a rule known among persons skilled in the art, these are once again only briefly outlined so as to facilitate understanding of the invention.

The extrusion device 10 illustrated in FIG. 1, by means of which a so-called "direct" extrusion method may be performed, comprises a recipient 12, into which a material volume 15, for example of a light metal or light metal alloy material, in particular a magnesium material, is introduced. Terminating the recipient 12, illustrated in FIGS. 1 and 3 on the right, a die 14 is envisaged, which is formed to correspond to the section desired to be obtained from the profile 16. Essentially opposite the die 14, illustrated in FIGS. 1 and 3 on the left, a pressure disc 13 is envisaged, comparable with the seal 17 according to the extrusion device according to FIG. 3. Pressure is exerted via the pressure disc 13 on the material volume 15 located in the recipient 12 by means of a punch 11, cf. FIG. 1. By means of heating measures not separately illustrated here, the material volume 15 located in the recipient is heated up and extruded in the course of the press process from the extrusion device via the die 14 as an extrusion or profile 16.

In the case of the extrusion device 10 in accordance with FIG. 2, by means of which a so-called "indirect" extrusion method can be performed, the pressure is exerted by means of a punch 14 via a combination of pressure disc 13 and die 14 on the material volume 15 in recipient 12, which on one side is terminated by a locking piece, which is arranged almost statically in the recipient 12. Due to the pressure which is exerted through the punch 11, via the pressure disc 13 and the die 14 on the material volume 15, the extrusion 16 or the profile constituting the extrusion reaches the exterior due to the punch 11, which is executed in concave fashion in the direction of pressure. In the case also of the extrusion device 10 according to FIG. 2, the recipient 12 is suitably heated (not illustrated), so that the material volume 15 can be brought to a suitable temperature to carry out the extrusion process.

The extrusion process 10 in accordance with FIG. 3, by means of which a so-called "hydrostatic" extrusion method can be performed, is similar in respect to its structure essentially to the structure of the extrusion device 10 in accordance with FIG. 1. The extrusion device 10 in accordance with FIG. 3 differs, however, from that according to FIG. 1 in that the punch 11 at its free end is provided with a seal 17, which ensures that the material volume 15 arranged in the recipient 12 and a pressure fluid 18, which surrounds the material volume 15 in the recipient 12, cannot escape from the extrusion device. For this the die 14 is also provided with a seal 20 opposite the recipient 12. When the punch 11 is moved into the recipient 12, a pressure which exerts itself on the material volume 15 from all sides via the pressure fluid 18 builds up in the recipient 12. The pressure thus builds up from all sides equally on the material volume 15, which as a result leaves the extrusion device 10 as an extrusion or profile 16.

The method for the production of profiles 16 of light metal or light metal alloy materials, in particular magnesium materials, by means of extrusion, is preferably performed with an extrusion device 10 according to FIG. 3, by means of which the "hydrostatic" extrusion mentioned is possible. Here a material volume 25, which is constituted by the light metal or light metal alloy material, is pressed through the die 14 in the form of the desired profile 16. A grain refiner which can be constituted, by way of example, of zirconium, strontium and calcium, is added to the light metal or light metal alloy material to form the material volume that can be used for the extrusion process. By this means the microstructure of the light metal or light metal alloy material is refined. The metals of the rare earths can also be used as grain refiners.

By means of the method, not only is a higher press speed up to 250 m $min^{-1}$ and/or a lower press temperature of the material volume of, for example, in the range of 150 to 350° C. attained, which in comparison to conventional extrusion methods is considerably lower, but the forming of profiles with press ratios from 200 to 500 is possible (press ratio—section area of the initial material in relation to the section area of the profile).

As evidence of the goal that can be achieved in accordance with the invention, reference is also made to FIGS. 4 and 5, in which the microstructure of an extruded metal ingot, that is of a material volume 15 of AZ 31 is illustrated in comparison with a material with the designation ME 10, which has been modified with zirconium as the refining material, cf. FIG. 5. Comparison of both figures allows identification of significant grain refinement. Thus one finds grain sizes of 400-600 μm for the material AZ 31 and grain sizes of 100-200 μm for the modified or refined material ME 10.

The alloying range which, for example, is suitable for the application of the hydrostatic extrusion method, see also FIG. 3, is compiled in Table 1. Along with the variation of the basic alloys (ME 10, ZE 10, AZ 31-AZ 61), alloy concentrations are given.

Table 2 shows the composition of alloys which had been investigated as examples.

Essential mechanical parameters for some traditional alloys and the modified or refined exemplar alloys are compiled in Table 3.

TABLE 1

Composition of optimised alloys for the hydrostatic extrusion process

| Name | Zn | Al | Mn | Ca | Zr | S.E. | Sr |
|---|---|---|---|---|---|---|---|
| ME mod. | — | — | 0.2-1.1 | — | 0.2-0.8 | 0.15-0.25 | — |
| ZE mod. | 1.0-1.4 | — | — | — | 0.2-0.8 | 0.15-0.25 | — |
| ME mod. | — | — | 0.2-1.1 | — | — | 0.15-0.25 | 0-0.2 |
| ZE mod. | 1.0-1.4 | — | — | — | — | 0.15-0.25 | 0-0.2 |

TABLE 1-continued

| Composition of optimised alloys for the hydrostatic extrusion process | | | | | | | |
|---|---|---|---|---|---|---|---|
| Name | Zn | Al | Mn | Ca | Zr | S.E. | Sr |
| AM mod. | 0-0.2 | 1.8-6.5 | 0.2-0.5 | 0.3-2.0 | — | 0-3.0 | — |

All details are in weight percent, HP restrictions: Ni<0.004 weight percent, Cu<0.008 weight percent, Si<0.05 weight percent, remainder: Mg,

TABLE 2

| Composition of exemplar alloys | | | | | | |
|---|---|---|---|---|---|---|
| Name | Zn | Al | Mn | Ca | Zr | S.E. |
| ME10 mod. | — | — | 0.19 | — | 0.18 | 0.22 |
| ZE10 mod. | 1.4 | — | — | — | 0.54 | 0.2 |
| AM60 mod. | 0.22 | 5.6 | 0.38 | 0.32 | — | — |

All details are in weight percent, HP restrictions: Ni<0.001 weight percent, Fe<0.004 weight percent, Cu<0.008 weight percent, Si<0.05 weight percent, remainder: Mg,

TABLE 3

Mechanical parameters of selected conventional modified alloys after hydrostatic extrusion (examples from Table 2)

| | Tensile test | | | Pressure test | |
|---|---|---|---|---|---|
| Alloy | $R_{p02}$ [Mpa] | $R_m$ [Mpa] | Tensile yield [%] | $R_{p02}$ [Mpa] | $R_m$ [Mpa] |
| M1 | 192 | 268 | 12 | 86 | 396 |
| ZM21 | 175 | 258 | 23 | 116 | 418 |
| AZ31 | 198 | 278 | 23 | 155 | 418 |
| ME10 + Zr | 192 | 237 | 32 | 171 | 364 |
| ZE10 + Zr | 235 | 273 | 25 | 164 | 388 |
| AM60 + Ca | 207 | 302 | 25 | 174 | 414 |

KEY

10. Extrusion device

11. Punch

12. Recipient

13. Pressure disc

14. Die

14. Material volume (light metal or light metal alloy material)

16. Extrusion (profile)

17. Seal

18. Pressure fluid

19. Locking piece

20. Seal

What is claimed:

1. A method for producing a profile of a magnesium-based material comprising:

(a) adding a grain refiner comprising a metal of the rare earths to a magnesium-based material in a first step; and (b) hydrostatically extruding the grain refiner and magnesium-based material through a die at a material temperature of 150° C. to less than 300° C. and a press ratio from 200 to 500 to produce a profile of the magnesium material.

2. The method of claim 1, wherein the extruder has a press speed of more than 125 m/min to 250 m/min.

3. Method according to claim 1, characterised in that the extrusion is effected by means of a hydrostatic press method.

4. Method according to claim 1, characterised in that the extrusion is effected by means of a hydrostatic press method.

5. Method according to claim 2, characterised in that the extrusion is effected by means of a hydrostatic press method.

* * * * *

UNITED STATES PATENT AND TRADEMARK OFFICE

CERTIFICATE OF CORRECTION

PATENT NO. : 8,590,356 B2
APPLICATION NO. : 10/592331
DATED : November 26, 2013
INVENTOR(S) : Kainer et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1780 days.

Signed and Sealed this
Twenty-second Day of September, 2015

Michelle K. Lee

Michelle K. Lee
*Director of the United States Patent and Trademark Office*